United States Patent [19]

Fisher et al.

[11] 4,241,902

[45] Dec. 30, 1980

[54] SYSTEM FOR VESSEL EXCHANGE

[75] Inventors: Howard M. Fisher, New Castle; Rashed N. Nagati, Mars, both of Pa.

[73] Assignee: Pennsylvania Engineering Corporation, Pittsburgh, Pa.

[21] Appl. No.: 57,759

[22] Filed: Jul. 16, 1979

[51] Int. Cl.[2] ..... C21B 13/00

[52] U.S. Cl. ..... 266/44; 75/60

[58] Field of Search ..... 266/44; 75/60

[56] References Cited

U.S. PATENT DOCUMENTS

| | | | |
|---|---|---|---|
| 3,312,544 | 4/1967 | McCready | 75/60 |
| 3,944,083 | 3/1976 | Fisher | 266/36 P |
| 4,099,709 | 7/1978 | Calderon | 266/44 |

*Primary Examiner*—P. D. Rosenberg
*Attorney, Agent, or Firm*—Fred Wiviott

[57] ABSTRACT

A system for moving metallurgical vessels includes a hydraulic vessel lifting apparatus designed to raise the vessel out of supporting contact with a horseshoe-shaped trunnion ring and for lowering it onto a specially designed transfer car. The car moves the vessel to relining or bottom exchange stations where the vessel is removed by a similar hydraulic lifting apparatus from the car. The car is then used to move a second vessel to the operating station and position it on the trunnion ring. The melt shop layout includes a turntable for permitting the vessel transfer car to be selectively directed to desired locations.

20 Claims, 4 Drawing Figures

SYSTEM FOR VESSEL EXCHANGE

FIELD OF THE INVENTION

The present invention relates generally to the art of metallurgical apparatus and, more specifically, to a system for exchanging vessels which permits a vessel to be repaired while a second vessel is being employed for metallurgical processing.

BACKGROUND OF THE INVENTION

It is necessary to periodically repair metallurgical vessels because the lining thereof deteriorates over time and, in the case of bottom blown steel converters, it is necessary to periodically repair the bottom asembly by rebuilding the refractory bottom and/or replacing tuyeres. It is desirable that bottom removal or vessel relining be accomplished in a minimal amount of time in order to minimize disruption of production. Hand methods of vessel bottom replacement and furnace relining are very time consuming and require a considerable number of workmen.

Methods are known for facilitating the removal and replacement of the bottom assemblies of bottom blown vessels. One such method is described in Fisher et al. U.S. Pat. No. 3,944,083 issued Mar. 16, 1976 for "Bottom Handling Apparatus for Steel Converter Vessels". The bottom handling apparatus comprises a movable frame assembly mounted, for example, on a ladle car and the assembly includes a support surface and hydraulic cylinders for positioning the support below the vessel. Means are provided for providing a downward breakaway force on the vessel bottom to release same. In an alternate embodiment, a plurality of jacks are provided on the vessel bottom itself for exerting a breakaway force between the vessel and the vessel bottom assembly.

While the apparatus described in this patent is considerably more efficient than hand methods, the vessel itself is still out of use during the time required for removal of the bottom, the time required for the car to transport the bottom assembly to a repair station, deposit it there, travel to a different repair station, load a repaired bottom assembly, transport the latter to the vessel and the time required for the work crew to install the new bottom. Moreover, the apparatus described in this patent is not designed for improving the efficiency of repair of replacement of the vessel lining.

Downtime problems are especially important in smaller melt shops which have only a single refining station. In these shops, the downtime causes a total shut-down of production and a large waste of employee time. Downtime in such shops can last for days and a solution to the problem would result in a significant advance in this technology. A solution to this problem must take into account the space requirements of such melt shops and must not interfere with the other metallurgical apparatus generally located in such plants.

OBJECTS OF THE INVENTION

It is a primary object of the present invention to provide a vessel exchange, bottom exchange and refractory removal and replacement system.

It is another object of the present invention to provide an exchange car for accomplishing the foregoing object.

Another object of the present invention is to provide a single transfer car which is capable of both vessel transfer and bottom assembly removal.

Still another object of the present invention is to provide a high pressure hydraulic system which serves a variety of jacking functions.

Yet another object of the present invention is to provide a transfer car, which besides its bottom exchange device, moves the vessel on rigid supports, offering a high degree of stability and safety during vessel transport.

Another object of the present invention is to provide a system for self-propelling the transfer car.

A further object of the present invention is to provide a turntable which permits the car to deliver a vessel to rebricking, relining or bottom repair stations.

Another object of the present invention is to provide high pressure jacks which are displaced from the furnace after use to prevent damage to the jacks and to provide the necessary clearances for normal furnace operation.

How these and other objects of the present invention are accomplished will be described in the following specification taken in conjunction with the FIGURES. Generally, however, the objects are accomplished by a specially designed metallurgical vessel which includes a plurality of jacks mounted adjacent thereto for raising the vessel above and out of supporting contact with a generally horseshoe-shaped trunnion ring. A vessel transfer car is positioned beneath the elevated vessel so that stationary support pillars on the car are positioned beneath lift plates mounted to the exterior of the vessel. The vessel is then lowered onto the support pillars. The transfer car preferably includes a bottom handling apparatus such as the one described in the aforementioned Fisher et al. patent so that the car can later be used for detaching the bottom. With the vessel loaded on the car, the car is driven to a turntable where it is oriented for delivery of the vessel to one of several repair stations. When it reaches the repair station, hydraulic jacks are employed to place the vessel on another turnnion ring, thus freeing the exchange car for movement to a further repair station where loading of a second vessel takes place. The transfer car then returns to the operating station and positions the second vessel over the lifting jacks. The latter are used to raise the vessel away from the exchange car, allowing it to be driven away from the vessel. The lifting jacks are then lowered to place the vessel on the trunnion ring. The exchange procedure is completed by securing the new vessel to the ring and by connecting the piping typically required by such vessels.

DESCRIPTION OF THE PREFERRED EMBODIMENT

Figure 1:
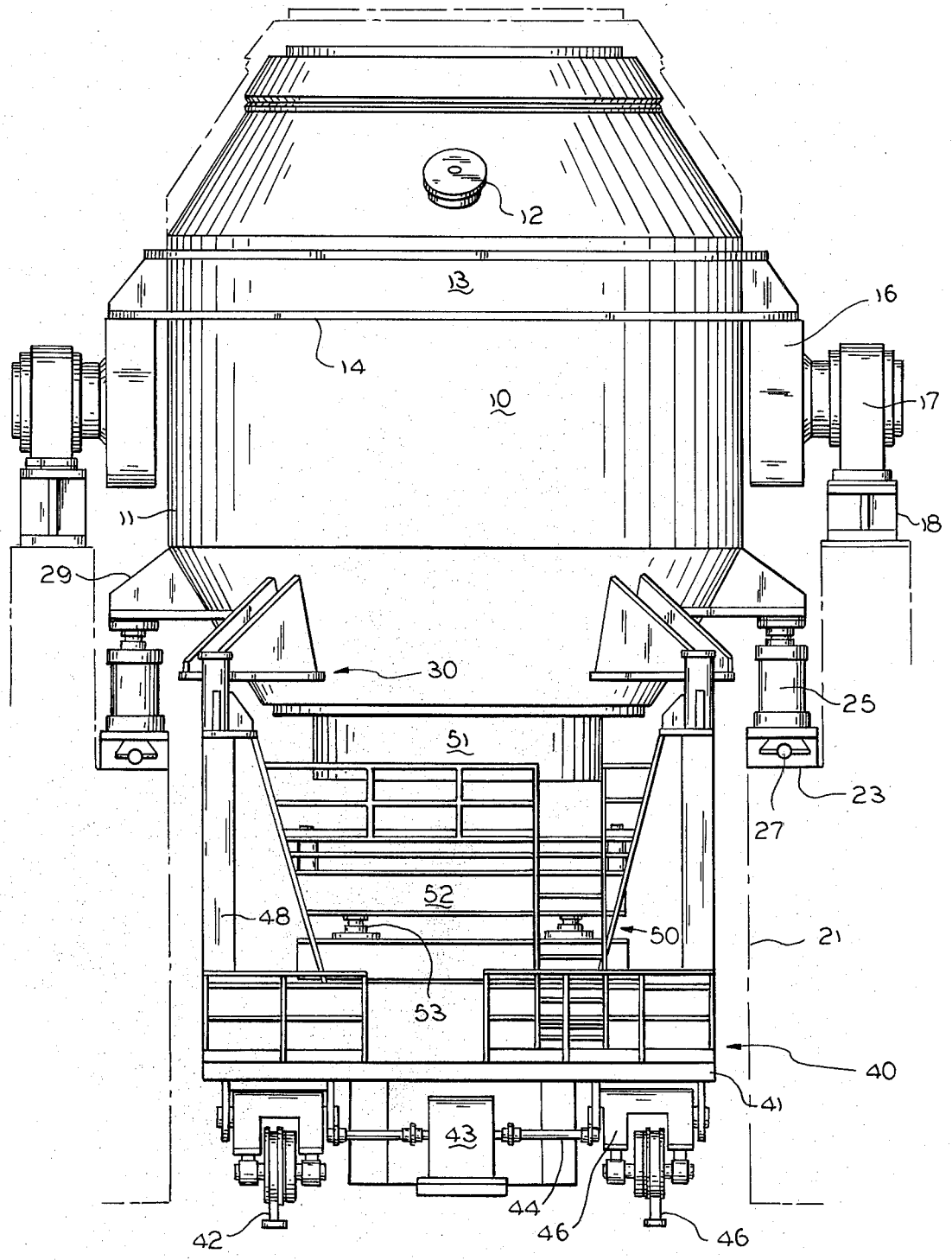
FIG. 1 is a front perspective view of a metallurgical vessel support and exchange system according to the preferred embodiment of the present invention.

Before beginning the description of the preferred embodiment of the present invention, it should be understood that the particular metallurgical vessel depicted in the drawings is for illustration purposes only and that the principles of the invention are applicable to a wide variety of metallurgical vessels. For example, the invention can be employed with either top or bottom blown steel converter vessels. Also, it should be understood that some of the conventional apparatus used with such vessels has not been included in the drawings, so that the features of the invention can be more clearly depicted. For example, the tuyeres and their related piping are not shown.

Referring now to FIG. 1, an open top metallurgical vessel 10 is shown to include a metallic shell 11 and a pouring spout 12. Vessel 10 also includes an annular rim 13 which includes a lower planar surface 14 adapted for resting upon a generally horseshoe-shaped trunnion ring 16 (see FIG. 4). Trunnion ring 16 is supported by bearing structures 17, one of which includes a suitable drive mechanism for tilting the vessel 10 to various positions to permit charging, deslagging, sampling, temperature measurement, or discharge of hot metal through pouring spout 12.

Vessel 10 is secured to trunnion ring 16 in a known manner, such as the vessel suspension device described in Fisher's U.S. Pat. No. 3,799,527, issued Mar. 26, 1974 for "Suspension Assembly For Metal Treating Vessel". This apparatus includes a quick release assembly which permits the rapid detachment of the vessel from the trunnion ring while supporting the vessel in a centralized position relative to the ring regardless of thermal expansion. The preferred quick release device uses wedges which are driven into tapered slots to lock the vessel 10 to trunnion ring 16.

Vessel 10 is supported above the floor of the steel plant in a pit which includes vertical side walls 21. The bearings 17 are themselves supported by pillars 18 on each of the side walls 21, and in the illustrated embodiment, the pit includes a pair of ledges 23 which extend along either side of vessel 10 below the level of pillars 18. On each of the ledges 23 two extensible hydraulic jacks 25 are mounted and jacks 25 are adapted for movement from a first position shown in solid line in FIG. 2 to a second position shown in dotted line in FIG. 2. Movement of the jacks between these two positions may be accomplished in a number of ways, for example using lead screws 27 shown in FIG. 1.

Jacks 25 are arranged for engaging four lifting plates 29 when they are in their first position. The plates themselves are affixed to vessel 10 below the level of trunnion ring 16 and in the illustrated embodiment are located at thirty degree (30°) angles in front of and behind the axis of trunnion bearings 17. By reference to FIG. 1, it can also be seen that the lower surfaces of plates 29 are just slightly above the upper surfaces of jacks 25 when the jacks 25 are lowered. It will be appreciated then that vessel 10 may be elevated by extending the pistons of jacks 25 by a short distance to the dotted line vessel position shown in FIG. 1.

Jacks 25 each include a quick disconnect coupling for a hydraulic hose as will be explained later in this specification. From the foregoing description, it can now be appreciated why jacks 25 need to be movable. In their first positions, jacks 25 would not provide sufficient clearance from plates 29 to allow the vessel to be tilted, but when jacks 25 are in their second positions the vessel can move about the axis of bearings 17 without interference. Moreover, when the jacks are in their second positions they are displaced from the intense heat of the furnace and protected from possible damage from spilling metal and the like. It is also within the scope of the present invention to provide cavities (not shown) within side walls 21 to provide additional protection of the jacks 25 when they are in their second position.

Vessel 10 also includes support plates 30 affixed to vessel 10 about two feet below the level of lifting plates 29. In the illustrated embodiment four such plates 30 are provided at forty-five degree (45°) angles with respect to the axis of trunnion bearings 17. While four plates 29 and 30 are shown in the drawings it should be apparent that additional plates can be provided if necessary for lifting or support stability. It has been found, however, that four of each type of plate is preferred for vessels in the 150 ton range.

Figure 3:
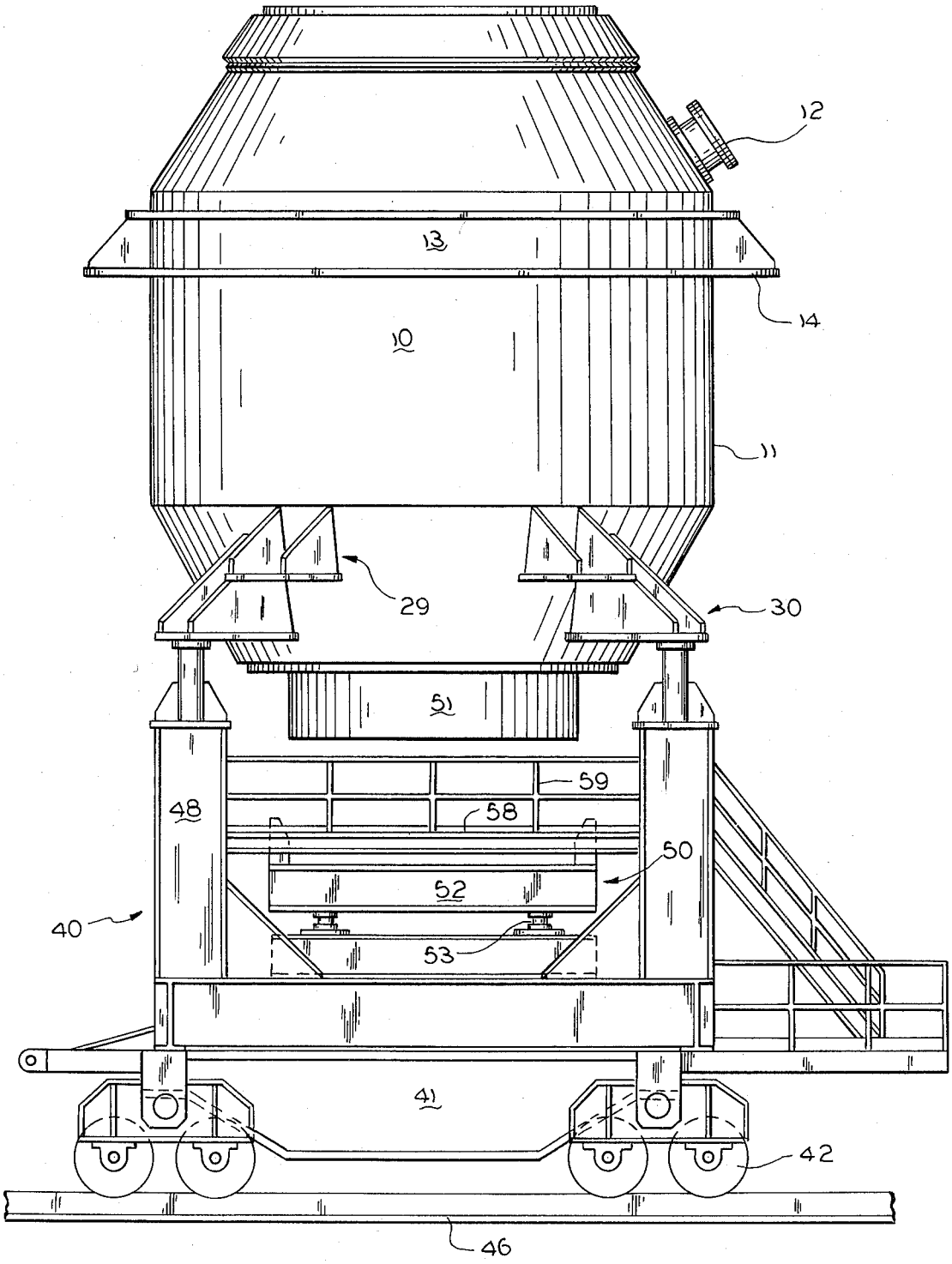
FIG. 3 is a side perspective of the metallurgical vessel of FIGS. 1 and 2 supported on a transfer car.

In addition to the unique vessel liftings and support plate arrangement just described, the present invention also includes a vessel exchange car 40 shown in FIGS. 1 and 3. Vessel exchange car 40 includes a support platform 41 mounted on wheels 42. In the illustrated embodiment, eight such wheels are provided. A motor 43, shafts 44 and drive gears 45 are also provided on car 40 for driving same in either forward or reverse directions. The details of the drive system are not provided but the car can be driven either by conventional electric motor, gear reducer drives or by hydraulic motors attached to multiple wheels. The power supply for the self-propelling mechanism is not shown in the drawings but may include an electrical cable wound on a reel which winds and unwinds cable as the car approaches or moves away from the power source. Car 40 engages rails 46 which pass under vessel 10 intermediate side walls 21 and to other locations in the plant as will be described in connection with FIG. 4.

Mounted to each corner of platform 41 is a rigid support pillar 48 which extends to a height which is just slightly above the bottom surface of plates 34 (when vessel 10 is resting on the trunnion ring 16). The arrangement of pillars 48 should coincide with the arrangement of plates 30 and pillars 48 should have sufficient strength to adequately support vessel 10.

Car 40 also includes a bottom assembly handling device 50 shown in general form in FIGS. 1 and 3. The preferred bottom handling device 50 is the one described in the aforementioned et al. U.S. Pat. No. 3,944,083 and the disclosure of that patent is expressly incorporated herein by the reference. Bottom handling device 50 is designed for supporting and removing the bottom 51 of vessel 10 if it needs to be repaired. The device includes a support table 52 and hydraulic cylinders 53 for raising same into contact with bottom 51. While not shown in the drawings, other cylinders can be provided for tilting the support table or for rotating same to insure proper alignment. Device 50 can also include the downward breaking force inducing components of the aforementioned patent.

As can be seen in FIGS. 1 and 3, car 40 also includes a crew walkway platform 58 and guard rails 59, all designed for permitting the work crew to have access to the vessel bottom.

Car 40 is also fitted with two hydraulic systems, one of which is low pressure and serves the known functions associated with the bottom exchange device. The hoses, pump and hydraulic fluid tank associated with this system have not been shown in the drawings. The other system is a low/high pressure system 62 connected to four flexible hoses 63 which include quick disconnect couplings 64 at their free ends. These hoses 63 may be used by the crew either to connect to hand held pumps used to break away the bottom from vessel 10 or to jacks 25 for vessel lifting.

Figure 4:
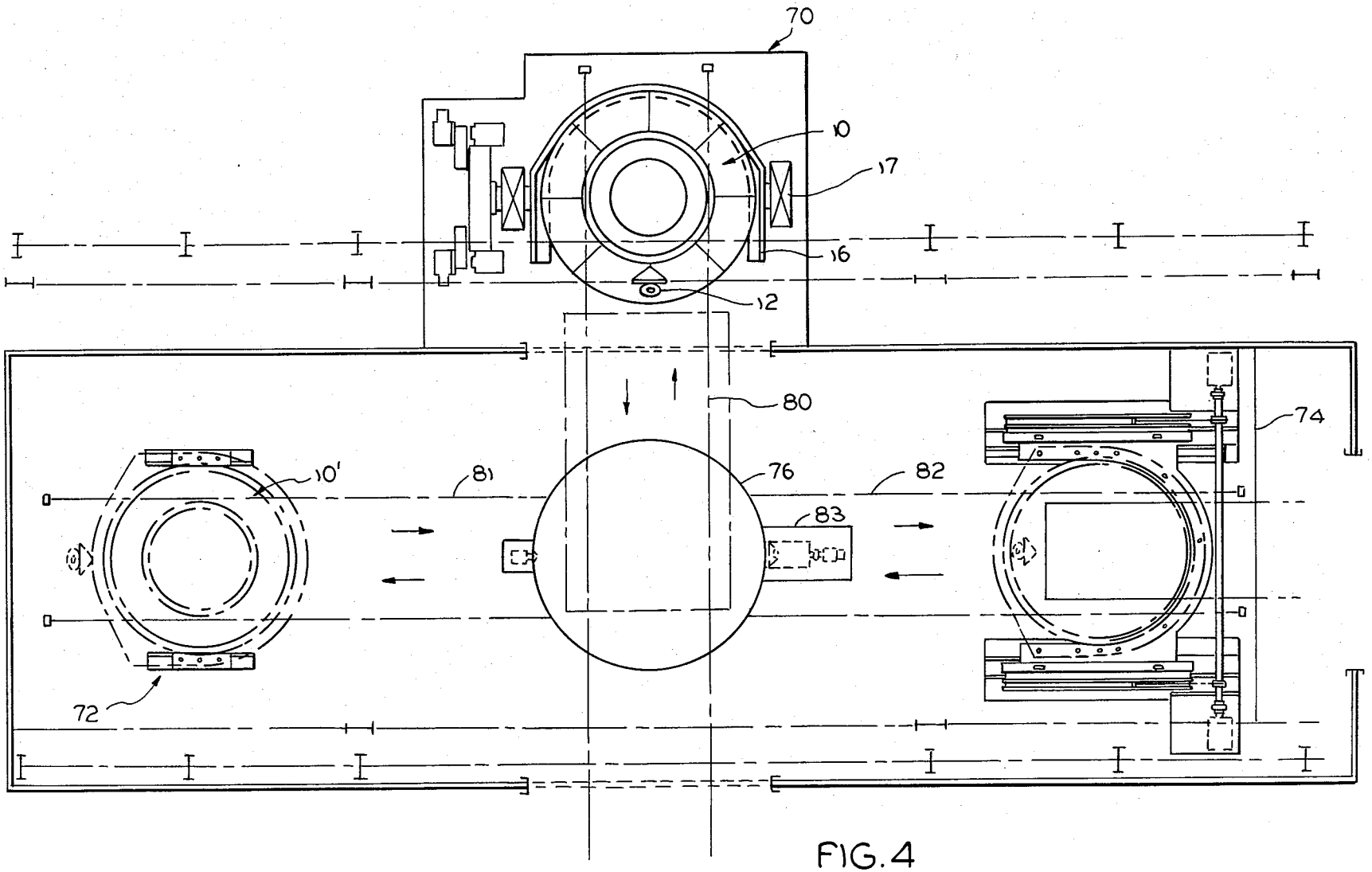
FIG. 4 is a plan view of a melt shop employing the features of the present invention.

Before proceeding to the description of the method of operation of the present invention, reference should now be had to FIG. 4 for an explanation of one exemplary layout for a vessel exchange system. In the layout drawing the operating position is designated 70 and first and second repair stations are designated 72 and 74 respectively. Each position includes a trunnion ring support and the jack configuration described above with reference to FIG. 1. The layout also includes a turntable 76 disposed between stations 70, 72 and 74 and three sections of track 80–82 connecting respectively operating position 70 and turntable 76, turntable 76 and repair station 72, and turntable 76 and repair station 74. It will be appreciated then that a transfer car 40 can be directed to any of these positions by being placed on the turntable 76 and rotating the table to the correct position. The turntable itself may be rotated in any known manner, e.g. using an electrically driven chain. FIG. 4 also shows hydraulic wedge rail positioner 83 as is known to the art. In a preferred embodiment of the invention, station 72 is equipped for vessel relining and for bottom installation while station 74 is a refractory and bottom removal station.

Proceeding now to a description of the method of operation of the vessel exchange system of the present invention, it will be assumed that vessel 10 at position 70 needs to be relined and that a back-up vessel 10[1] has been prepared and is located at station 74. Vessel 10 is parked upright in the blowing position and the wedges which secured the vessel to trunnion ring 16 have been disengaged, as have the bottom brackets and supply piping normally employed with steel converting vessels. Transfer car 40 has moved onto track section 80 in an approach position to station 70.

Figure 2:
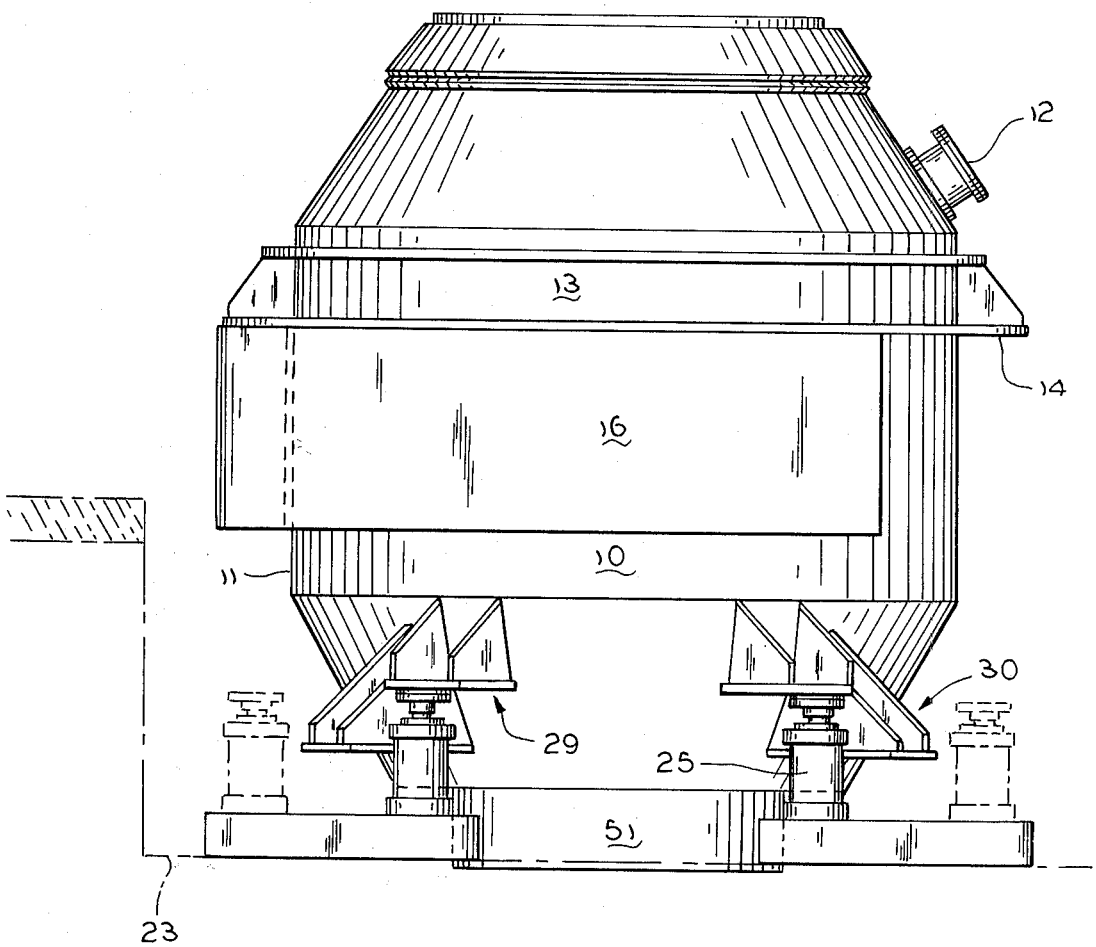
FIG. 2 is a partial side view of the system shown in FIG. 1, illustrating in solid and dotted line the two lifting jack positions.

The quick disconnect couplings 64 of hoses 63 are connected to the jacks 25 while the jacks are located in the dotted line position as shown in FIG. 2, and the jacks 25 are then moved into position (solid line FIG. 2) under the lifting plate 29. The jacks 25 are then extended to lift vessel 10 about 18". With vessel 10 lifted, car 40 is moved beneath the vessel and located so that the support plates 30 are immediately above the support pillars 48. It should be remembered that the height of pillars 48 are above the original bottom of support plates 29, so that to lower the vessel, the jacks 25 need be lowered only 2" or so. Jacks 25 are then lowered to leave the vessel 10 supported on pillars 48 and the hydraulic hoses 63 are disconnected from the jacks.

Car 40 is then driven to turntable 76 (at a rate of about 20 feet per minute) and spotted at the center of turntable 76. The turntable is then rotated 90° to point the car in the direction of the refractory and bottom removal station 74. The car is moved toward station 74 and spotted so that the lifting plates of vessel 10 are above the lift cylinders associated with that station. Hoses 63 are coupled to these lift cylinders and the jacks are elevated about 18" to raise vessel 10 off the support pedestals 48 (16" of this lift is under no load and 2" of load lifting). The car 40 then moves away from station 74 to an approach position, following which the vessel is lowered onto the trunnion ring of station 74 and hydraulic hoses 63 are disconnected from the station 74 lifting cylinders.

The car then moves to the relining stand 72, no change in the position of turntable being necessary since stands 72 and 74 are connected by track which lies along a straight line and because car 40 fits beneath the vessels whether it is backed into position or driven forwardly to the various positions.

Vessel 10[1] is raised 18" from its support after the hydraulic hoses of transfer car 40 are coupled to the station 74 lifting jacks. Car 40 is moved beneath vessel 10[1] and spotted so that pedestals 48 are beneath the support plates of the new vessel. The jacks are lowered 2" to seat the shell on the supports and are then lowered 16" under a no load condition. Following these steps, the hydraulic hoses are disconnected and the car moves the vessel to turntable 76, the turntable is rotated 90° toward the vessel operating position, and the turntable is locked.

The exchange procedure is completed by moving the vessel 10[1] to the approach position, hooking up the jack operating hydraulic lines, spotting the vessel over the jacks, lifting the cylinders 18" (again 16" of this lift being under a no load condition), moving the car back to the approach position and lowering the jacks to set the shell onto the horseshoe trunnion ring. After the jacks are lowered to their rest positions and moved to their rest positions, the vessel is secured to the trunnion ring using locking wedges or some other similar systems, the bottom brackets and piping are connected and the lining burned in to complete the cycle.

As previously mentioned, car 40 can also be used for bottom removal. For example, following the vessel exchange procedure the car is spotted on the turntable 76 and the table is rotated to the refractory and bottom removal station 72 and locked. Using the procedures described above in conjunction with the bottom removal apparatus 50, the bottom is removed, the bottom is repaired and reinstalled and the vessel 10 is then moved to the reline station where new refractory is added, the shell is preheated (if desired) and otherwise prepared for the next cycle.

While the invention has been described with reference to one preferred embodiment, the invention is not to be limited thereby but is to be limited solely by the claims which follow.

We claim:

1. A metallurgical vessel handling apparatus comprising:

a metallurgical vessel;

trunnion means for partially surrounding and supporting said vessel at a first height;

lift means adjacent said vessel for engaging said vessel and vertically lifting same relative to said trunnion means to a second height;

transfer means for being movably positioned beneath said vessel when said vessel is at said second height, said transfer means including vessel support means for engaging and supporting said vessel when said vessel is at a third height intermediate said first and second heights;

power means for said lift means; and means for driving said transfer means.

2. The invention set forth in claim 1 wherein said lift means comprises a plurality of jack means positioned adjacent to said vessel and below said trunnion means, said jack means being elevated from a lowered position to a raised position, and lift plate means on said vessel for engaging said jack means as the same are raised from their lowered to their raised positions to cause said vessel to be elevated from its first to its second height.

3. The invention set forth in claim 2 wherein said jack means are movable away from said vessel to prevent interference with vessel tilting.

4. The invention set forth in claim 2 wherein said vessel support means comprises a plurality of pillar means mounted on said transfer means, support plate means being provided on said vessel for engaging the top of said pillar means when said vessel at said third height.

5. The invention set forth in claim 2 wherein said power means comprises hydraulic means on said transfer means for being removably coupled to said jack means.

6. The invention set forth in claims 1, 2, 3, 4 or 5 wherein said transfer means comprises a self-propelled transfer car.

7. The invention set forth in claims 1, 2, 3, 4 or 5 wherein said trunnion means is a generally horseshoe-shaped trunnion ring.

8. The invention set forth in claims 1, 2, 3, 4 or 5 wherein a metallurgical vessel bottom handling device is mounted to said transfer means, said handling device being adapted for engaging, removing and supporting the bottom of a metallurgical vessel.

9. A metallurgical vessel exchange apparatus comprising:

a first station, said first station including a generally horseshoe-shaped trunnion ring for supporting a metallurgical vessel and jack means adjacent said vessel for engaging a vessel supported by said trunnion ring and lifting same vertically out of engagement with said trunnion ring;

transfer car means adapted for being positioned beneath said vessel when it is in its elevated position and including support means for engaging said vessel when the vessel is lowered by said jack means;

at least one additional station also including said trunnion ring and jack means;

means for moving said car means between said stations.

10. The invention set forth in claim 9 wherein said transfer car means includes hydraulic means and hose means for being removably coupled to said jack means for supplying the lifting force for said vessel exchange apparatus.

11. The invention set forth in claim 9 wherein said transfer car means includes a metallurgical vessel bottom handling means.

12. The invention set forth in claim 9 wherein said transfer car means is self-propelled and adapted for rolling movement on track means, and wherein said track means connect said stations.

13. The invention set forth in claim 10 wherein three such stations are provided and said apparatus includes turntable means coupled to said track means for selectively directing said transfer car means to each of said stations.

14. A metallurgical vessel exchange apparatus comprising:

a metallurgical vessel, said vessel having an annular support ring, a plurality of generally horizontal and coplanar lifting plate means attached to the exterior of said vessel below said ring, said vessel also including a plurality of generally horizontal and coplanar support plate means being attached to the exterior thereof, said lifting plate means being above and circumferentially displaced from said support plate means;

a generally horseshoe-shaped trunnion ring means for supporting said vessel and for permitting said vessel to be horizontally displaced through the opening in said trunnion ring means;

jack means mounted adjacent said vessel and including piston means for engaging said lift plate means and raising said vessel out of supporting contact with said trunnion ring means;

power means for said jack means;

transfer car means for being positioned beneath said vessel when same has been raised by said jack means, said car means including support post means for engaging said support plate means when said vessel is lowered by said jack means, the height of said post means being selected so that said vessel rests on said post means before said annular support ring contacts said trunnion ring means; and means for moving said car means.

15. The invention set forth in claim 14 wherein said power means comprises hydraulic means on said transfer car means and hydraulic hose means for being coupled to said jack means for causing extension and retraction of said piston means.

16. The invention set forth in claim 14 wherein said car means is self-propelled and is adapted for rolling movement on track means.

17. The invention set forth in claim 14 wherein said jack means are adapted for horizontal movement between first and second positions, in said first position said piston means being aligned with said lifting plate means and in said second position being displaced from said vessel.

18. A method of metallurgical vessel exchange comprising providing the apparatus of claim 14 and:

(a) extending said piston means to raise said vessel above said trunnion ring means;

(b) moving said transfer car means beneath said vessel and aligning the support plate means of said vessel above said post means;

(c) lowering said vessel until it is supported on said post means; and (d) moving said transfer car means to a location away from said trunnion ring means.

19. The invention set forth in claim 18 wherein said moving step comprises moving said transfer car means and supported vessel to another horseshoe-shaped trunnion ring means, jacks being provided adjacent said another ring, raising said vessel with said jack means out of supporting contact with said post means, moving said transfer car from beneath said trunnion ring means and lowering said vessel onto said another trunnion ring means.

20. The method of claim 19 including the further steps of moving said transfer car to a third location, placing a second vessel onto said support posts, moving said transfer car to the trunnion ring means supporting said first vessel and unloading same on said trunnion ring.

* * * * *